US011470976B2

(12) United States Patent
Kanthasamy

(10) Patent No.: US 11,470,976 B2
(45) Date of Patent: Oct. 18, 2022

(54) FOLDABLE OTTOMAN

(71) Applicant: Abedan Kanthasamy, Mississauga (CA)

(72) Inventor: Abedan Kanthasamy, Mississauga (CA)

( * ) Notice: Subject to any disclaimer, the term of this patent is extended or adjusted under 35 U.S.C. 154(b) by 0 days.

(21) Appl. No.: 17/162,212

(22) Filed: Jan. 29, 2021

(65) Prior Publication Data

US 2022/0240683 A1 Aug. 4, 2022

(51) Int. Cl.
*A47C 16/02* (2006.01)
*A47C 17/04* (2006.01)

(52) U.S. Cl.
CPC ..... *A47C 16/025* (2013.01); *A47C 17/04* (2013.01)

(58) Field of Classification Search
CPC ..... A47C 16/025; A47C 16/02; A47C 17/04
USPC ..... 297/423.1
See application file for complete search history.

(56) References Cited

U.S. PATENT DOCUMENTS 2,577,741 A * 12/1951 Creveling ..... A47C 17/04 297/109
3,049,724 A * 8/1962 Goodman ..... A47C 17/04 5/35
5,597,199 A * 1/1997 Hoffman ..... A47B 85/00 297/144
7,681,946 B2 3/2010 Arias et al.
9,226,586 B1 * 1/2016 Reid ..... A47C 20/021
9,380,880 B1 * 7/2016 Alexander ..... A47C 16/02
9,814,321 B2 * 11/2017 Garland ..... A47C 3/16
D881,593 S 4/2020 Li
D886,478 S 6/2020 Sokol
10,694,859 B1 * 6/2020 Wickland ..... A47C 4/045
2006/0284451 A1 * 12/2006 Hoffman ..... A47C 13/00 297/17
2011/0010846 A1 * 1/2011 Murphy ..... A47C 3/16 5/2.1
2011/0010847 A1 * 1/2011 Murphy ..... A47C 13/00 5/35

* cited by examiner

*Primary Examiner* — Mark R Wendell
(74) *Attorney, Agent, or Firm* — Harness, Dickey & Pierce, P.L.C.

(57) ABSTRACT

This present invention relates to furniture, and more specifically to an ottoman that can be folded into different positions to become a sofa, a recliner or a bed. The foldable ottoman comprises a base frame having supporting members and four legs, a center segment, a first end segment and a second end segment. The center segment has a base that is pivotally attached to two of the four legs. The first end segment has a base pivotally attached to two of the four legs and is also linked to a supporting platform, a pivotable leg handle is attached to the first segment base, and a supporting platform connected to the base. The supporting platform is able to tilt off the base at varying angles. The second end segment has a second end segment base that is pivotally attached to two of the four base frame legs and a pivotable leg handle attached to the second end segment base and may also be linked to a supporting platform.

18 Claims, 13 Drawing Sheets

FOLDABLE OTTOMAN

FIELD OF THE INVENTION

The present invention relates to furniture, and more specifically to an ottoman that can be folded into different positions.

BACKGROUND OF THE INVENTION

Furniture is often used in environments (e.g., residential, commercial, industrial, etc.) to support or otherwise aid in various human activities, such as seating, eating, sleeping, storage, and the like. Some pieces of furniture may be non-adjustable, while others may be adjustable or foldable to varying degrees. For example, foldable chairs that are used for providing temporary seating at events typically have a collapsible seat and legs that can pivot to fold under the seat. Recliner chairs are also known, and these chairs can have its back lowered and/or its front raised.

Foldable furniture allows users to take advantage of the space that traditional furniture would otherwise take up when not in use. Such foldable furniture appeals to users with restricted living space, as well as users who wish to enjoy the benefit of having more options to arrange the furniture in their living space. Space-saving furniture may also improve the ease of portability and transportation.

Ottomans in particular are typically known as sofas without a head, back or arms. They are typically square, rectangular or cylindrical in shape, with a flat top (see e.g., U.S. Design Pat. Nos. D881,593 and D886,478 for a cylindrical-shaped ottoman and a rectangular-shaped ottoman, respectively). Traditionally, ottomans have been used as standalone seats or paired with an armchair to act as a footstool. As the use of ottomans became more popular in various settings, some ottoman designs have included a hinged seat to permit storage of toys, magazines/books, clothing, upholstery, etc. Nevertheless, a significant portion of the utility of such ottomans rely on them being paired with other separate pieces of furniture. For example, an ottoman may be placed next to a chair or sofa for use as a foot rest.

Whereas there exist numerous full-length sofas that are convertible to function as a sofa bed, convertible ottomans are less common in the prior art. U.S. Pat. No. 7,681,946 discloses a foldable ottoman that is convertible to a seating unit having a backrest. Further, the typical recliner can have its back lowered and/or its front raised. However, none of these ottomans or recliners are collapsible, capable of numerous arrangements, or capable of functioning as both a standalone ottoman and a sofa, recliner or makeshift bed.

SUMMARY OF THE INVENTION

In an embodiment of this invention there is a foldable ottoman comprising, a base frame having base frame supporting members and four base frame legs, a center segment having a center segment base that is pivotally attached to two of the four base frame legs, a first end segment having a first end segment base that is pivotally attached to two of the four base frame legs, and a second end segment having a second end segment base that is pivotally attached to two of the four base frame legs and a pivotable leg handle attached to the second end segment base. The center segment, the first end segment and the second end segment may be upholstered.

In a further embodiment of the present invention, the foldable ottoman additionally comprises a supporting platform having a first supporting platform end and a second supporting platform end, wherein the supporting platform is adjacent to the first end segment, the first supporting base end is attached to the first end segment base, and the second supporting platform end is moveably attached to the first supporting platform end. The first supporting platform end may be moveably attached to the second supporting platform end by a click clack mechanism.

In a further embodiment of this invention: the center segment base is pivotally attached to two of the four base frame legs using segment links attached to the center segment base and the two of the four base frame legs; the first end segment is pivotally attached to two of the four base frame legs using segment links attached to the first end segment base and the two of the four base frame legs; and the second end segment base is pivotally attached to two of the four base frame legs using segment links attached to the second end segment base and the two of the four base frame legs.

In a further embodiment of the present invention, there is a foldable ottoman comprising a base pivotally attached to a first end segment, a center segment and a second end segment, wherein the ottoman is capable of moving from a first closed position in which the first end segment and second end segment are in a folded position inside the base and the center segment covers the base, to: a second position in which the center segment is extended away from the base and the first end segment and second end segment are in a closed position inside the base; a third position in which the center segment is extended away from the base and the first end segment is in an unfolded extended position outside of the base and the second end segment is in a closed position inside the base; a fourth position in which the center segment is extended away from the base, the first end segment and second end segment are all in an unfolded extended position outside of the base; and a fifth position in which the first end segment and second end segment are in unfolded extended positions outside of the base and the center segment covers the base.

The first end segment of the foldable ottoman may comprise a first end segment base and a supporting platform having a first supporting platform end and a second supporting platform end, where the supporting platform is adjacent to the first end segment and attached to the first end segment at the first supporting platform end and the first supporting platform end is connected to the second supporting platform end by a click clack mechanism, wherein the ottoman is capable of moving to a sixth position in which the first end segment and second end segment are in unfolded extended positions outside of the base and the center segment is folded back into a closed position on the base and the second supporting platform end is elevated up from the first segment base. The supporting platform apparatus may also be located on the second segment, or the first and second segment.

BRIEF DESCRIPTION OF THE FIGURES

These and other aspects of the present invention will be apparent from the brief description of the drawings and the following detailed description in which.

DETAILED DESCRIPTION OF THE FIGURES

Figure 1:
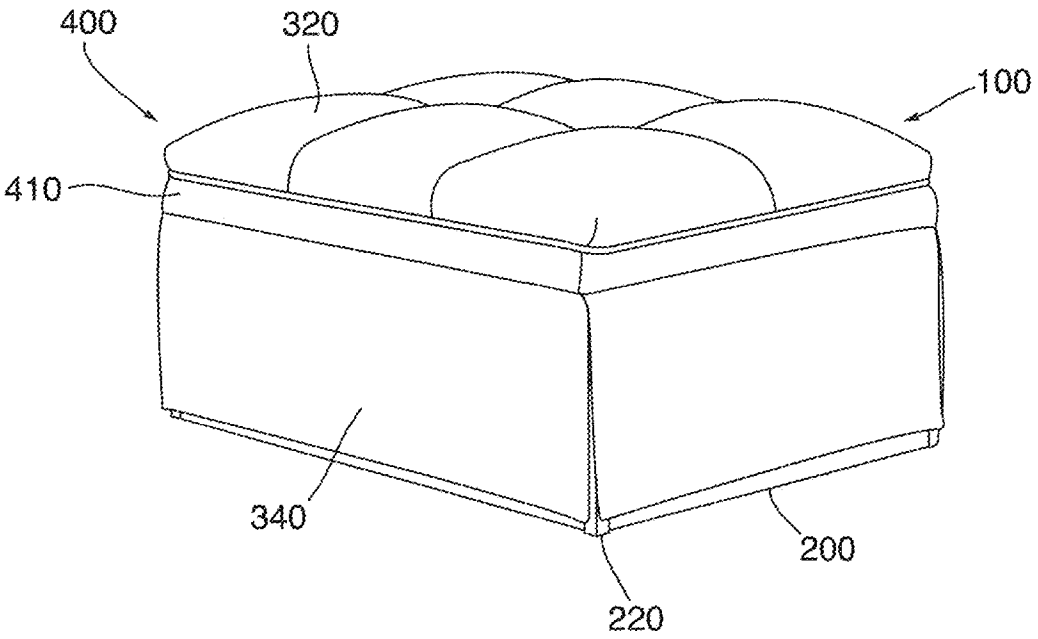
FIG. 1 is a perspective view of a foldable ottoman in a first position, according to an embodiment of the present invention.
Figure 6:
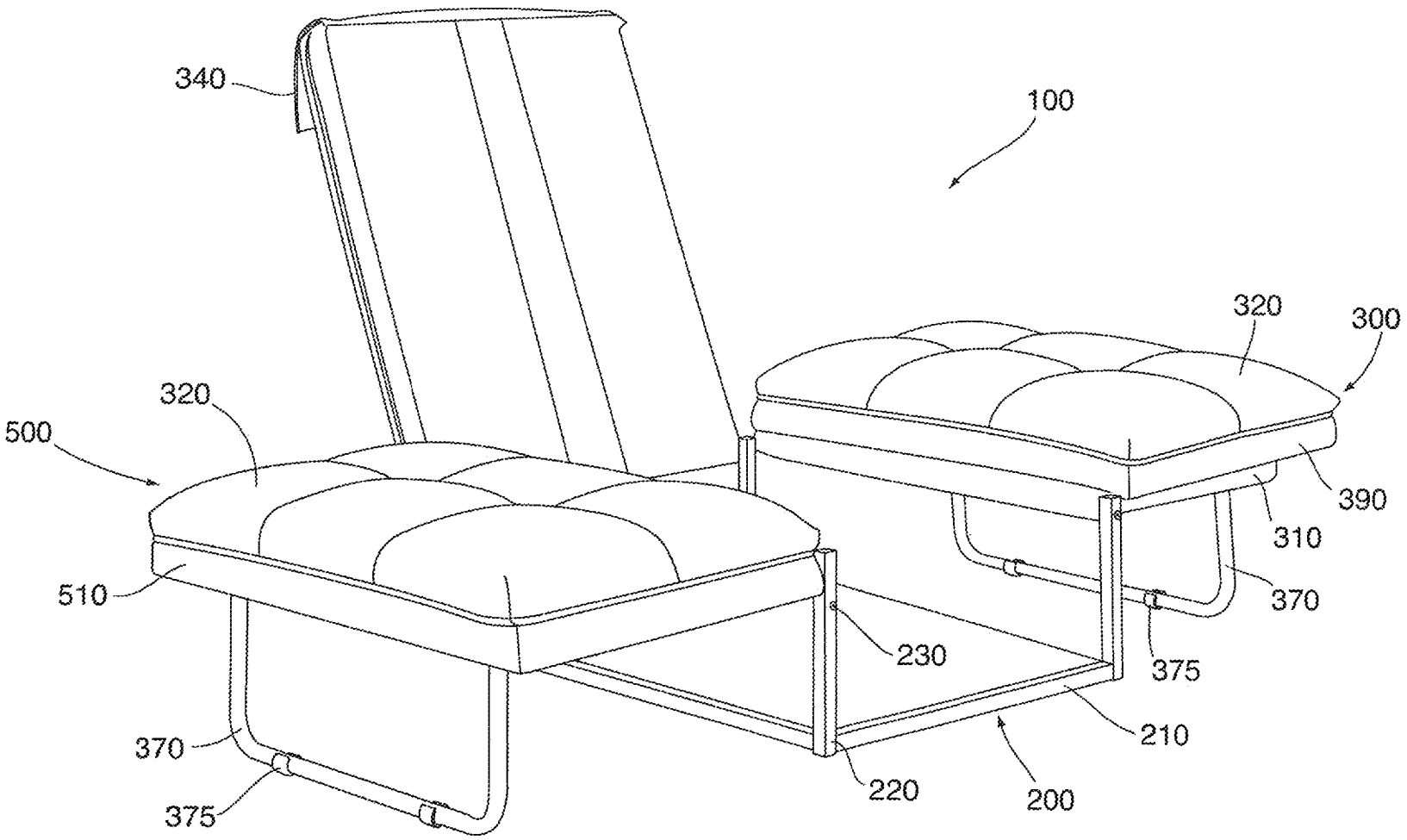
FIG. 6 is a perspective view of the foldable ottoman of FIG. 1 in a fourth position according to an embodiment of the present invention.
Figure 7:
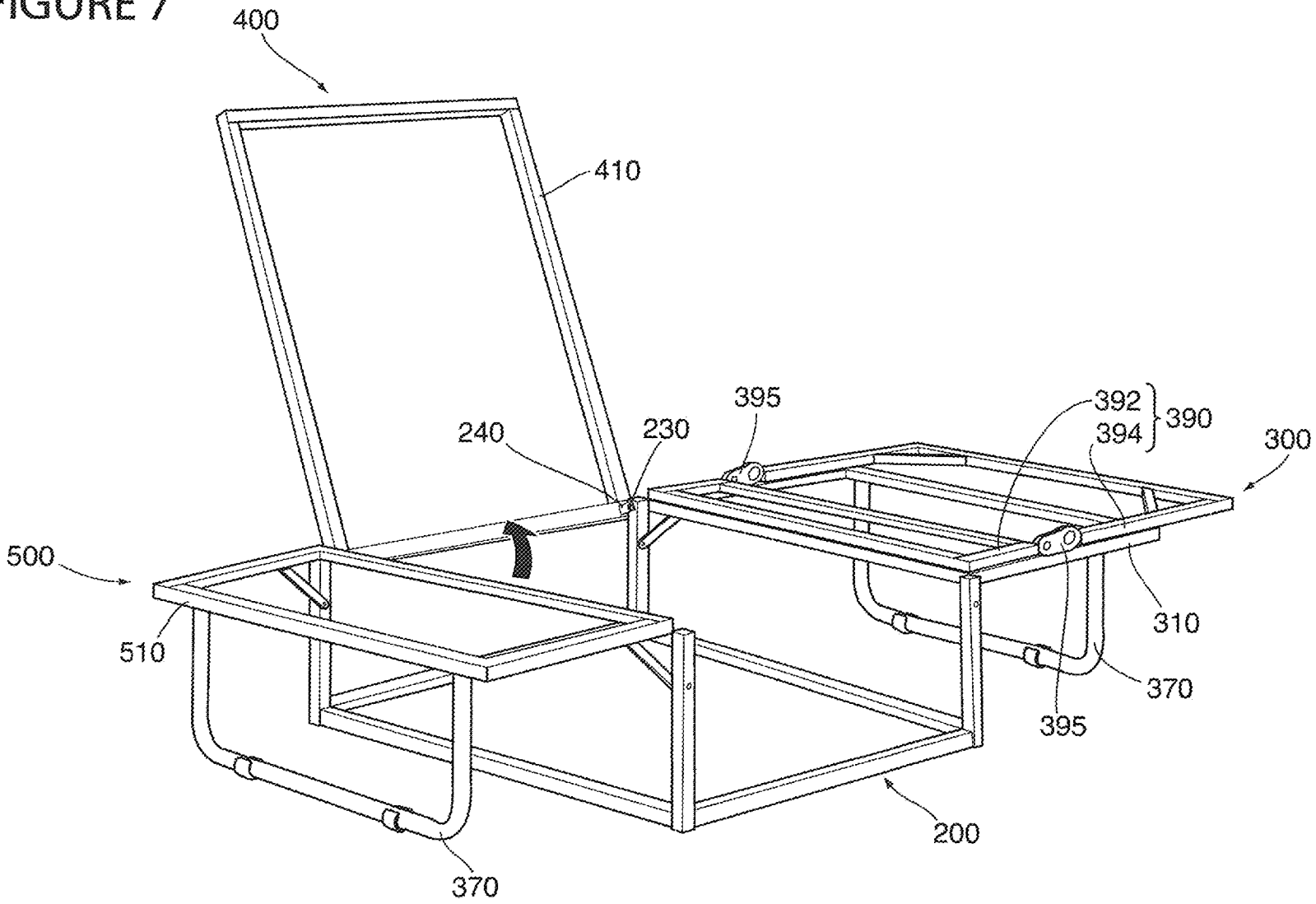
FIG. 7 is a view of FIG. 6, without upholstery.

In an embodiment of the present invention as shown in FIG. 1, there is a foldable ottoman 100 shown in a first closed position that can be manipulated into different configurations. As seen in FIGS. 6 and 7, the foldable ottoman 100 of the present invention has a base frame 200, a first end segment 300, a center segment 400 and a second end segment 500. The three segments 300, 400, 500 may be individually adjusted to achieve different configurations of the ottoman 100.

The three segments 300, 400, 500 are similar in size in the attached drawings, but it is understood that the invention may work with different configurations provided the first and second end segments 300, 500 fit into the base frame 200. Each of the three segments comprise a segment base 310, 410, 510. For ease of reference the parts of the frame have the same reference number when covered with fabric, except that as seen in FIG. 7, it is noted that a cushion 320 is attached to, and covering the top surface of, each sofa segment base 310, 410, 510. It is understood that the cushion 320 may be standard, pillow top or any other fabrication suitable to the ottoman 100.

Figure 2:
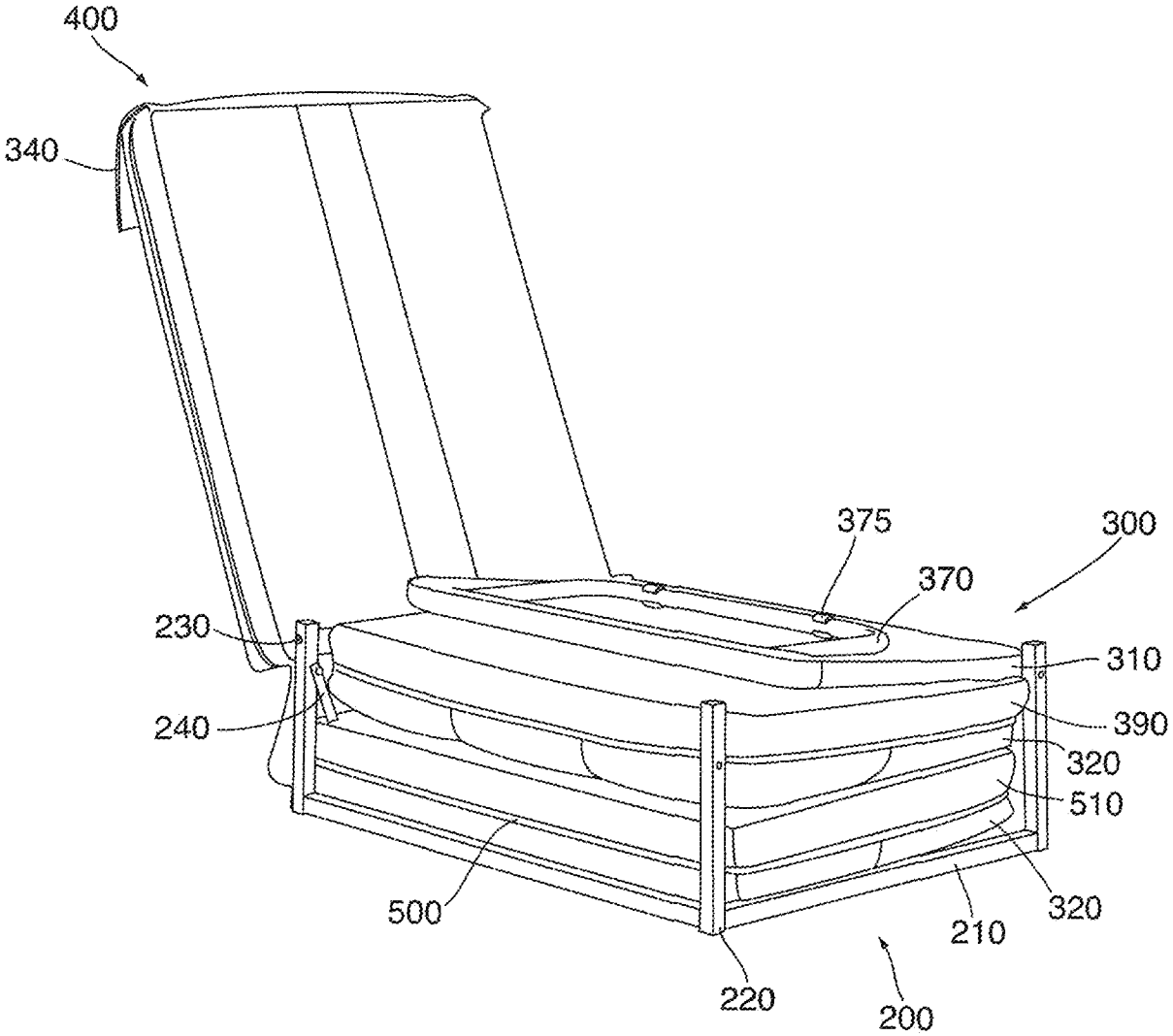
FIG. 2 is a perspective view of the foldable ottoman of FIG. 1 in a second position according to an embodiment of the present invention.
Figure 3:
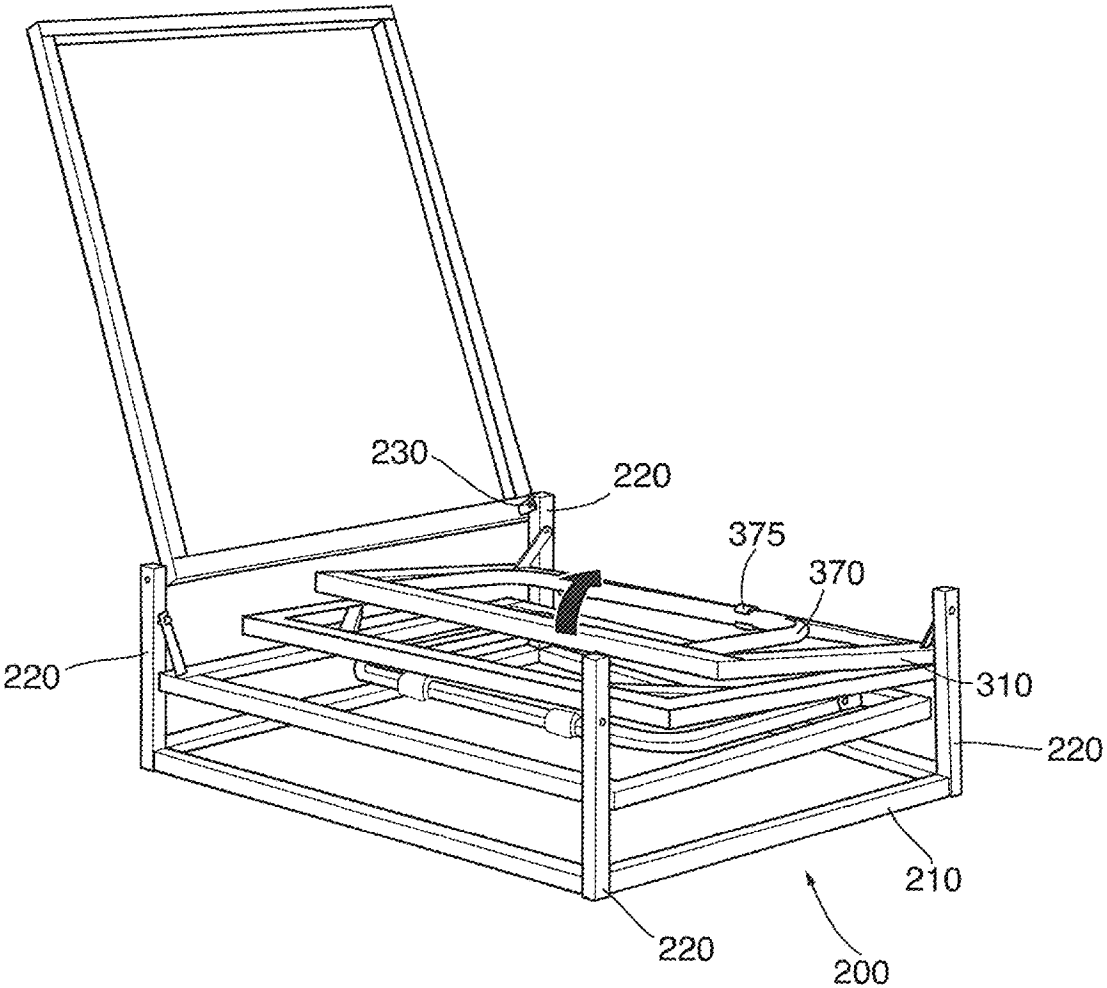
FIG. 3 is a view of FIG. 2, without upholstery.

As shown in FIGS. 2 and 3, in an embodiment of the present invention the base frame 200 comprises base frame supporting members 210, base frame legs 220 and pivots 230. The base frame support members 210 may be integral with the base frame legs 220 or the base frame supporting members 210 may be separate parts from the base frame legs 220 and connected using a fastening means such as screws, etc. The base frame support members 210 are substantially perpendicular to the base frame legs 220 and in an embodiment of the present invention the base frame legs 220 are located at the ends of the base frame supporting members 210.

Figure 5:
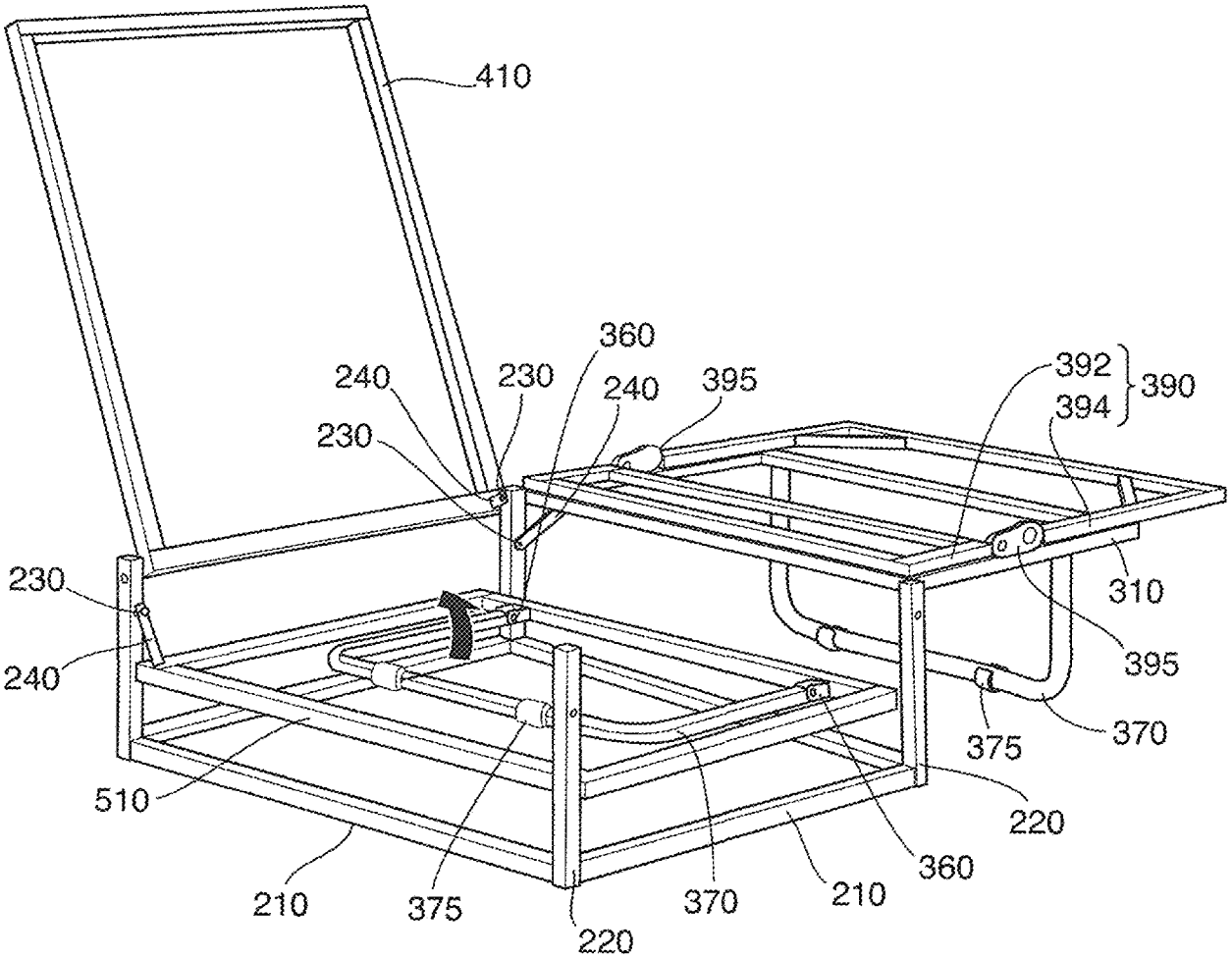
FIG. 5 is a view of FIG. 4, without upholstery.

As is seen in FIGS. 5 and 7, the center segment 400 is pivotally attached to two of the base frame legs 220 via pivots 230 and segment links 240. The foldable ottoman 100 is considered to be in second position when the center segment 400 has been lifted to reveal the entirety of the base frame 200 and the other two segments 300, 500 are housed inside the base frame 200. In an embodiment of the present invention, one sofa segment 300 is stacked on top of another sofa segment 500 when housed inside the base frame 200.

Figure 4:
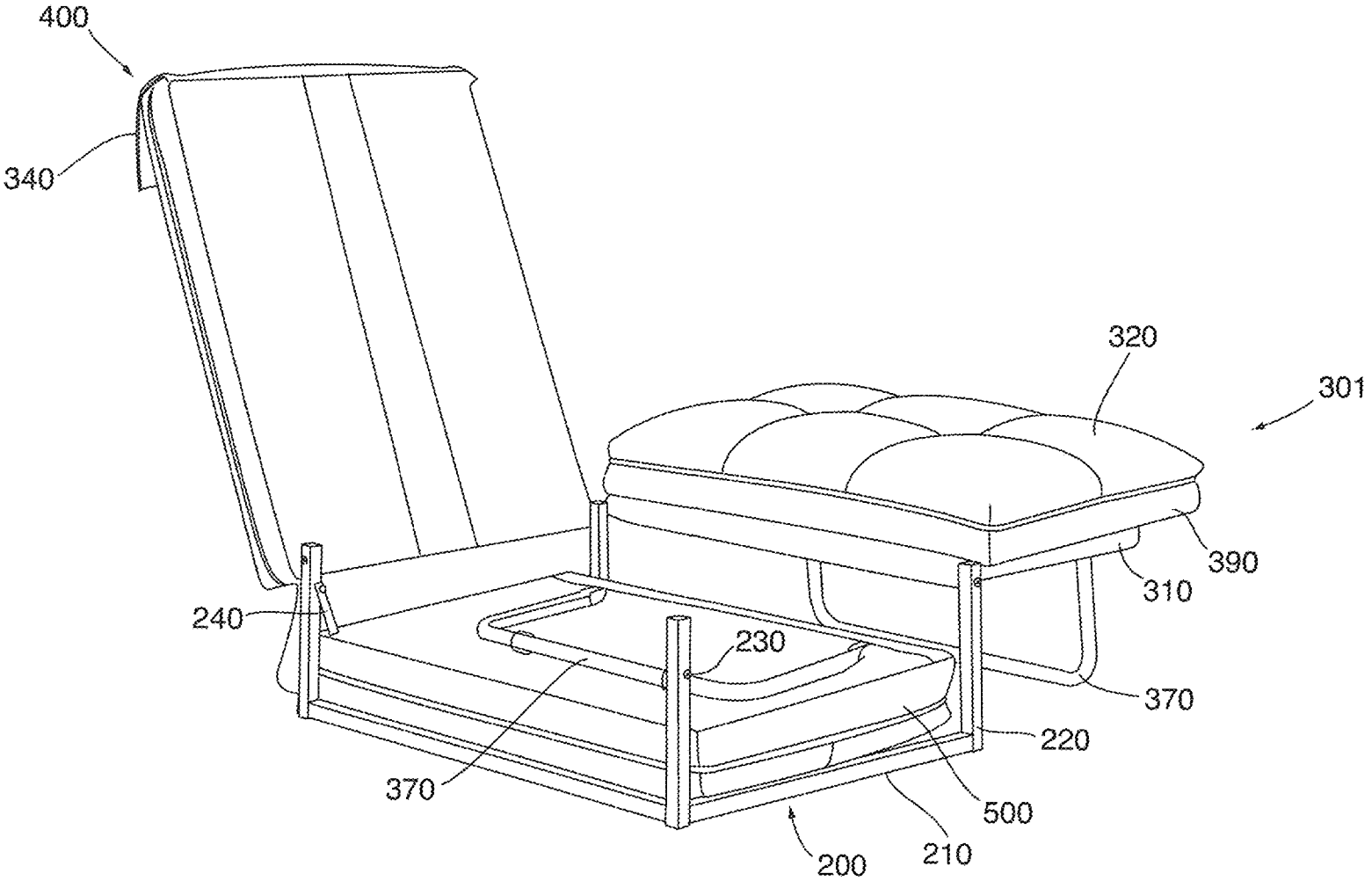
FIG. 4 is a perspective view of the foldable ottoman of FIG. 1 in a third position according to an embodiment of the present invention.

As shown in FIGS. 4 and 5, a pivotable leg handle 370 is attached to the first end segment base 310. Another pivotable leg handle 370 is attached to the second end segment base 510. The pivotable leg handles 370 may comprise at least one grip 375, which may provide increased friction when in contact with the ground to avoid the furniture from slipping on the ground. It is understood that the at least one grip 375 on the leg handle 370 is optional.

Slots 360 protrude from the bottom surface of the segment base 510 adjacent to where the pivotable leg handle is attached to the bottom surface of the second end segment base 510. The slots 360 act to both guide and restrict the plane of movement of the leg handle 370 to a range of about a 0-degree angle to about a 90-degree angle. It is understood that another mechanism could be used to permit the attachment of the pivotable leg handle to the segment base, while still providing the same range of motion of the leg handle.

Although not shown, the pivotable leg handle 370 is pivotably attached to the bottom surface of the first end segment base 310. Slots 360 protrude from the bottoms surface of the first end segment base 310 adjacent to where the pivotable leg handle is attached to the bottom surface of the supporting platform 390. It is understood that another mechanism could be used to permit the attachment of the pivotable leg handle to the segment base, while still providing the same range of motion of the leg handle.

In a further embodiment of the present invention shown in FIGS. 5 and 7, the first end segment 300 further comprises a supporting platform 390 adjacent to the first end segment base 310 and connected to the first end segment base 310 at the first supporting platform end 392 closest to the pivot 230 and segment link 24 attachment of segment base 310 to the base legs 220. The second supporting platform end 394 is not attached to the sofa segment base but is moveably attached to the first supporting platform end 392 using a click clack mechanism 395 that is known in the art of sofa beds. This permits the second supporting platform end 394 to be raised and lowered up off of the first end segment base 310 at varying angles as determined by the click clack mechanism.

It will be understood that in the embodiment of the present invention without a supporting platform, 390, the first end segment 300 will be like the second end segment 500.

The first end segment 300 is pivotally attached to two of the base frame legs 220 via the pivots 230 and segment links 240.

The second end segment 500 is also pivotally attached to two of the base frame legs 220 via pivots 230 and segment links 240. In this embodiment, each of the segment links 240 are attached to the bottom surface of the segment base 510 at one end, and one of the base frame legs 220 at the other end. The segment links 240 increase the range of movement of the segment 500, allowing it to be stacked underneath the first end segment 300 when housed inside the base frame 200 while also allowing it to be pivoted over the base frame legs 220 and outside of the base frame 200. The leg handles 370 function as a handle for an operator to easily fold and unfold the first and second end segments 300, 500 while also serving as legs to support each of the first and second end segments. As shown in FIGS. 4 and 5, the first end sofa segment 300 is in an unfolded position outside of the base frame 200 whereas the second end segment 500 is in a folded position inside the base frame 200.

As shown in FIG. 1, in a first position the center segment 400 operates as a cover to the base frame 200, which houses the first end segment 300 and the second end segment 500. In this first position, the foldable ottoman 100 can be used as a conventional ottoman. Optional flaps 340 on segment 400, typically made of fabric or leather, are decorative. The flaps 340 conceal at least a substantial portion of the base frame 200 as well as providing an aesthetically pleasing look to the foldable ottoman 100.

As shown in FIGS. 2 and 3, in a second position the center segment 400 is lifted off of the ends of the base frame supporting members thereby exposing the first end segment 300 and its pivotable leg handle 370.

As shown in FIGS. 4 and 5, in a third position the first end segment 300 is unfolded from the base frame supporting members 210 via the pivots 230 and the pivotable leg handle 370 rests on the ground forming a supported surface.

As shown in FIGS. 6 and 7, in a fourth position both the first and second end segments 300, 500 are in an unfolded position outside of the base frame 200. The center segment 400 is in an open position. The pivotable leg handles 370 of both the first and second end segments 300, 500 rest on the ground forming a supported surface.

Figure 8:
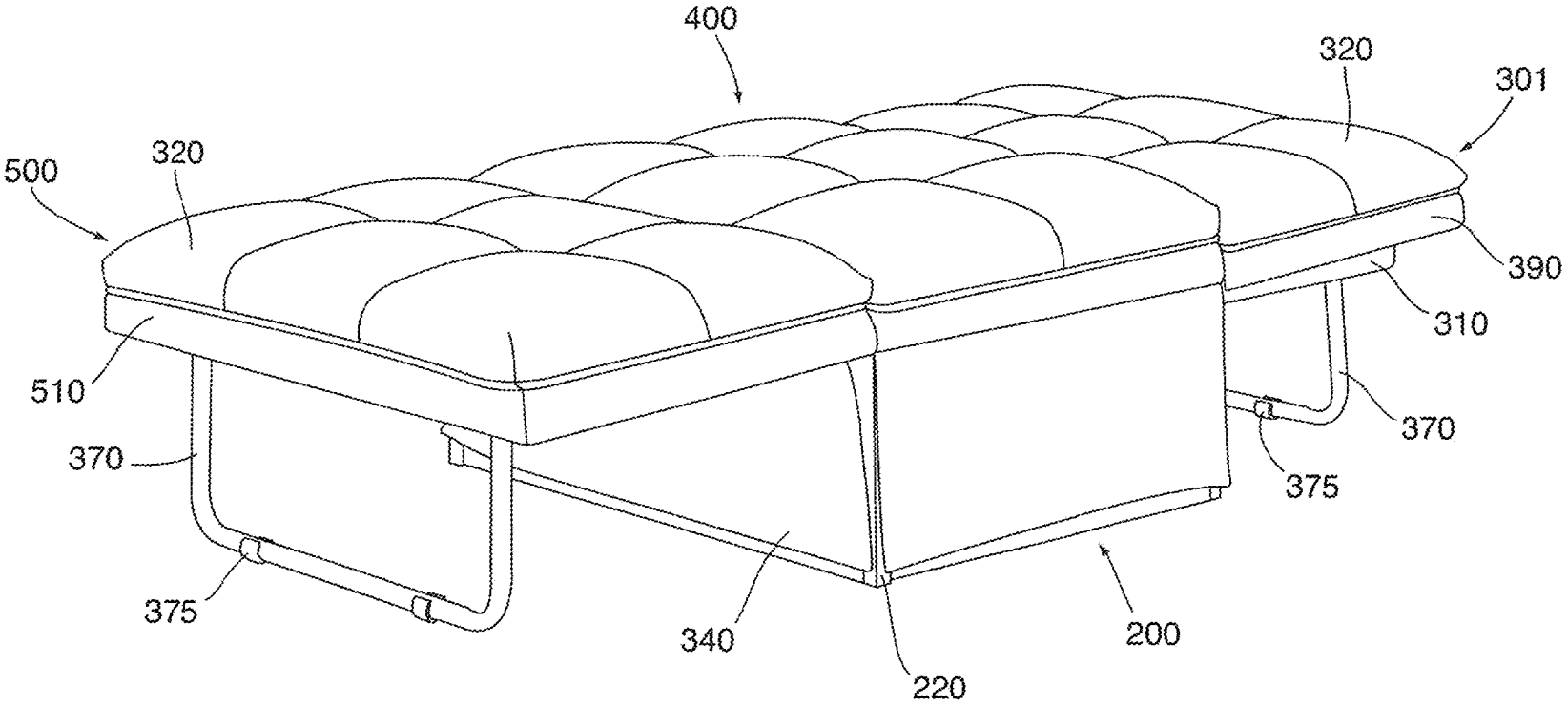
FIG. 8 is a perspective view of the foldable ottoman of FIG. 1 in a fifth position according to an embodiment of the present invention.

As shown in FIG. 8, the foldable ottoman is in a fifth position as the center segment 400 acts as a lid to the base frame 200 and the center segment 400 rests on the ends of the base frame legs 220. The center segment 400 is substantially in the same plane as the first and second end segments 300, 500. When the base frame 200 is not housing either of the first or second end segments 300, 500, it can be used as extra storage space. In the fifth position, the foldable ottoman can be used as a backless couch for multiple users or as a surface for a user to lay down on.

Figure 9:
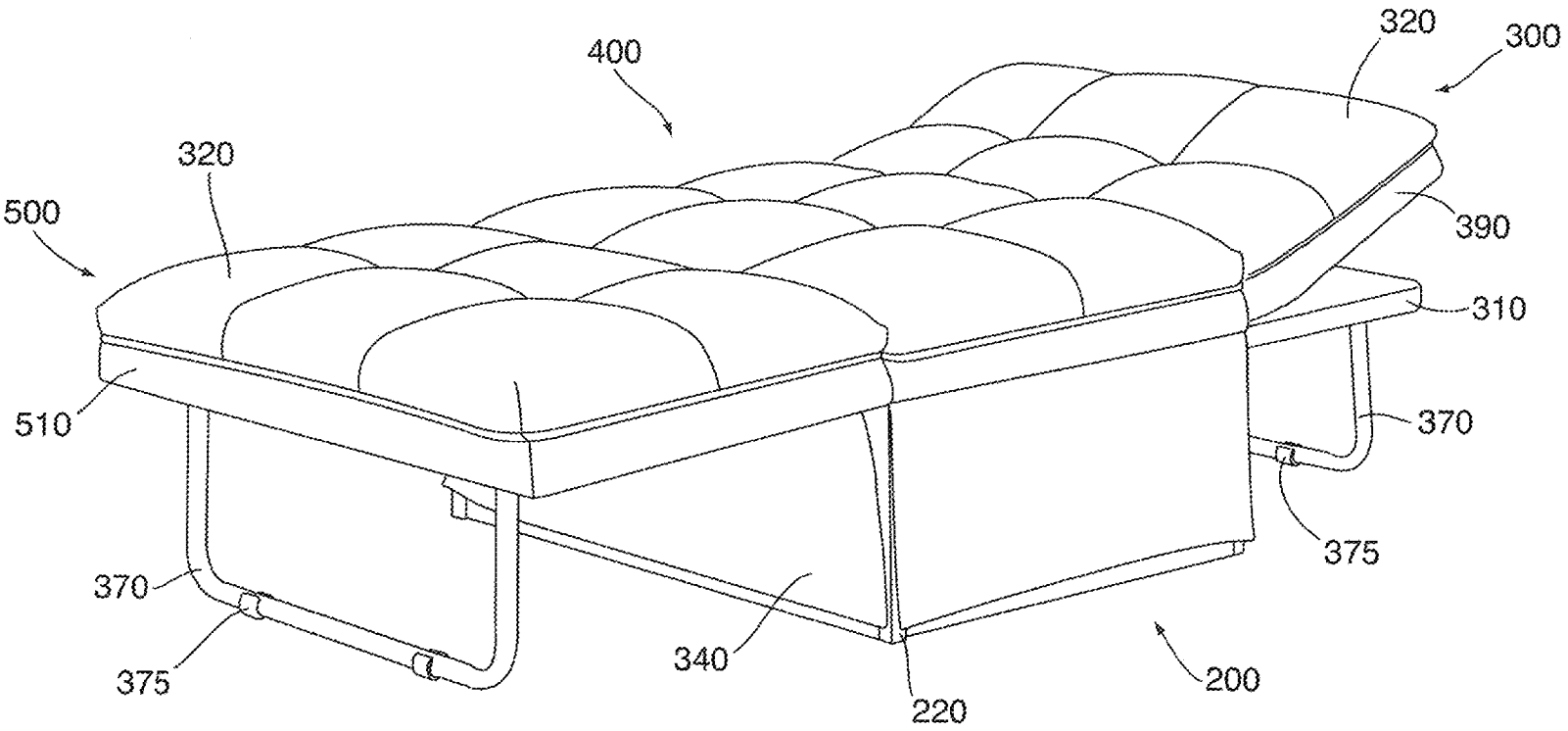
FIG. 9 is a perspective view of the foldable ottoman of FIG. 8 wherein a sofa segment is in a partially elevated position according to an embodiment of the present invention.

As shown in FIG. 9, in a variation of the fifth position the second supporting platform end 394 of the supporting platform 390 can be tilted up and off the first end segment base 310. Using the click clack mechanism 395 (shown in FIGS. 5 and 7), second supporting platform end 394 of the supporting platform 390 can be raised and lowered in varying degrees by the user to form an elevated surface of the cushion 320 attached to the first end segment 300.

Figure 10:
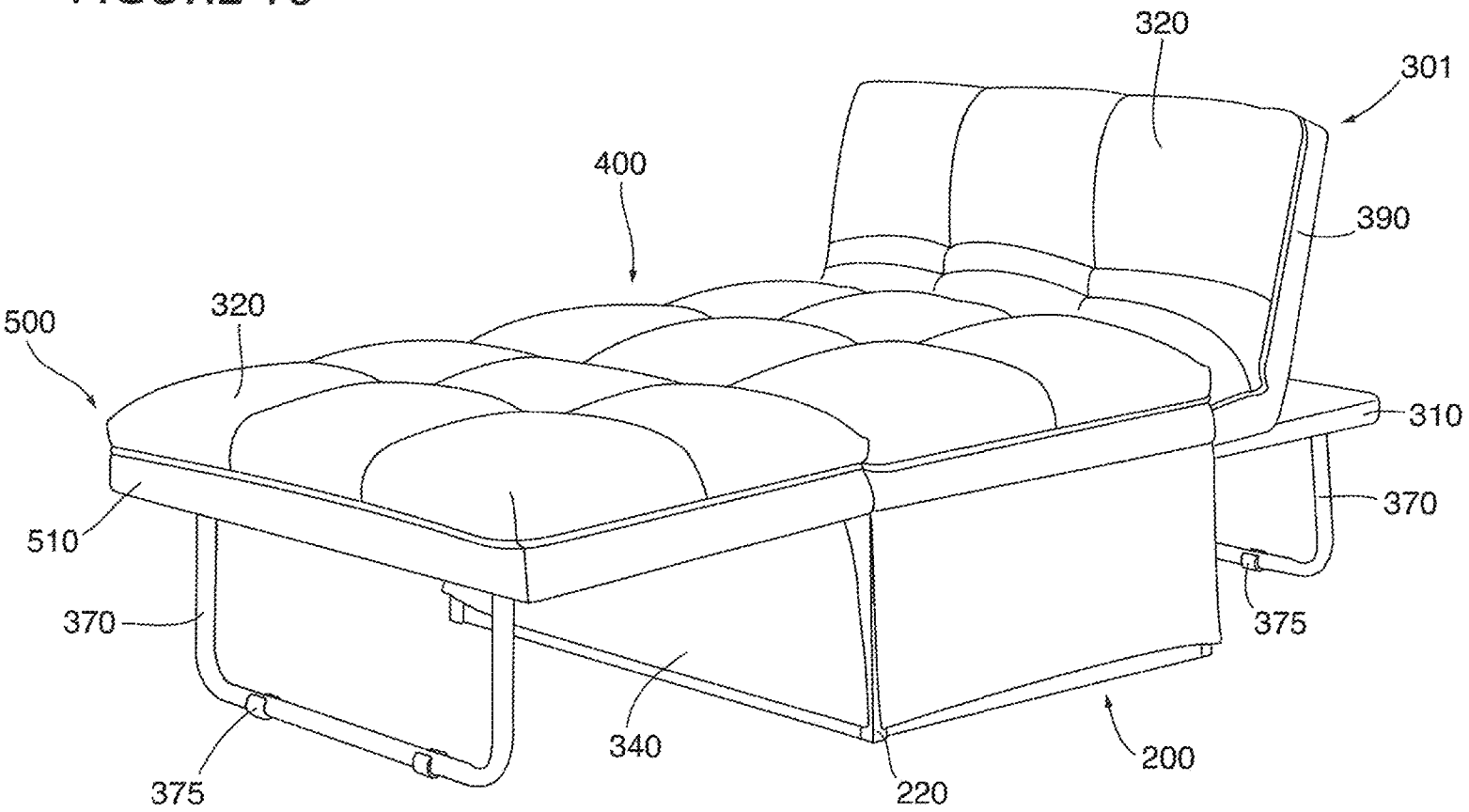
FIG. 10 is a perspective view of the foldable ottoman of FIG. 8 wherein a sofa segment is in a fully elevated position according to an embodiment of the present invention.

As shown in FIG. 10, the second supporting platform end 394 of the supporting platform 390 can be tilted up and off the first end segment base 310 into a substantially upright position (via the click clack mechanism 395) to act as a backrest like a more traditional sofa with the second end segment 500 acting as a footstool.

Figure 11:
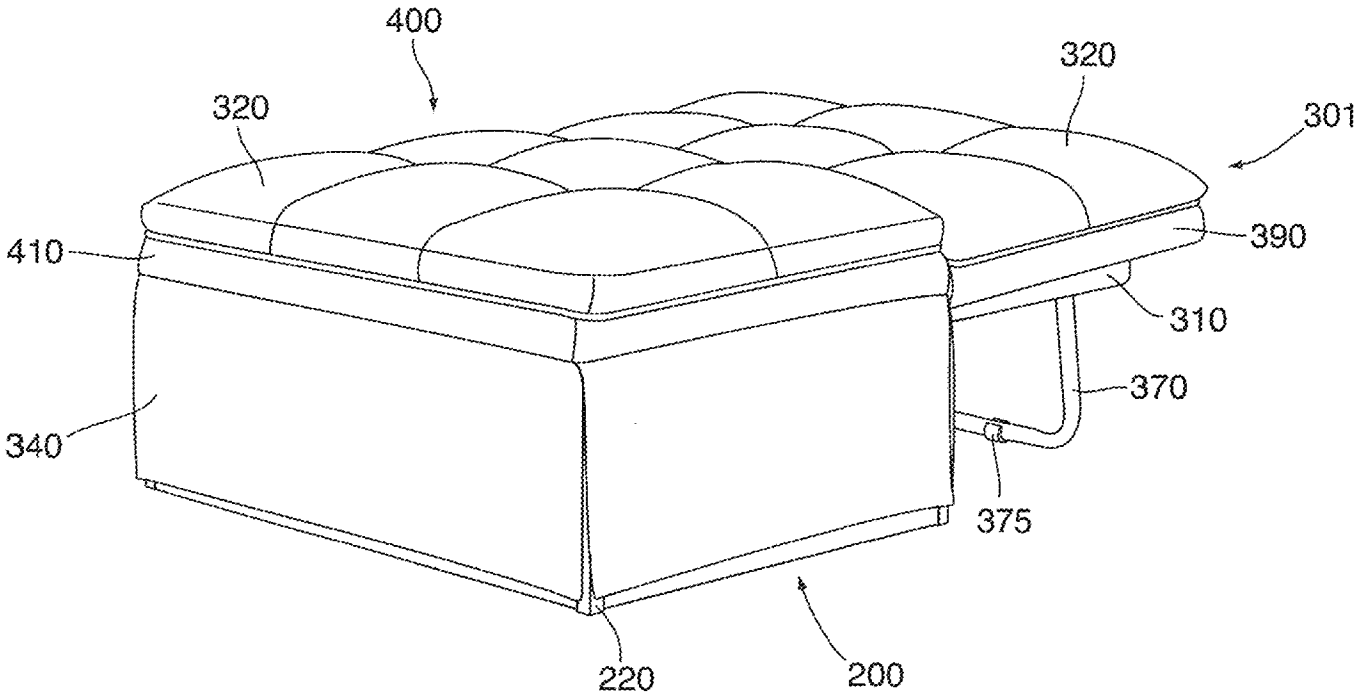
FIG. 11 is a perspective view of the foldable ottoman of FIG. 1 in a sixth position according to an embodiment of the present invention.

As shown in FIG. 11, the foldable ottoman is in a sixth position whereby the center segment 400 acts as a lid to the base frame 200 and the center segment base 410 rests on the ends of the base frame legs 220; the second end segment 500 is in a folded position housed inside the base frame 200; and the first end segment 300 is substantially in the same plane as the center segment 400 acting together as an extended ottoman.

Figure 12:
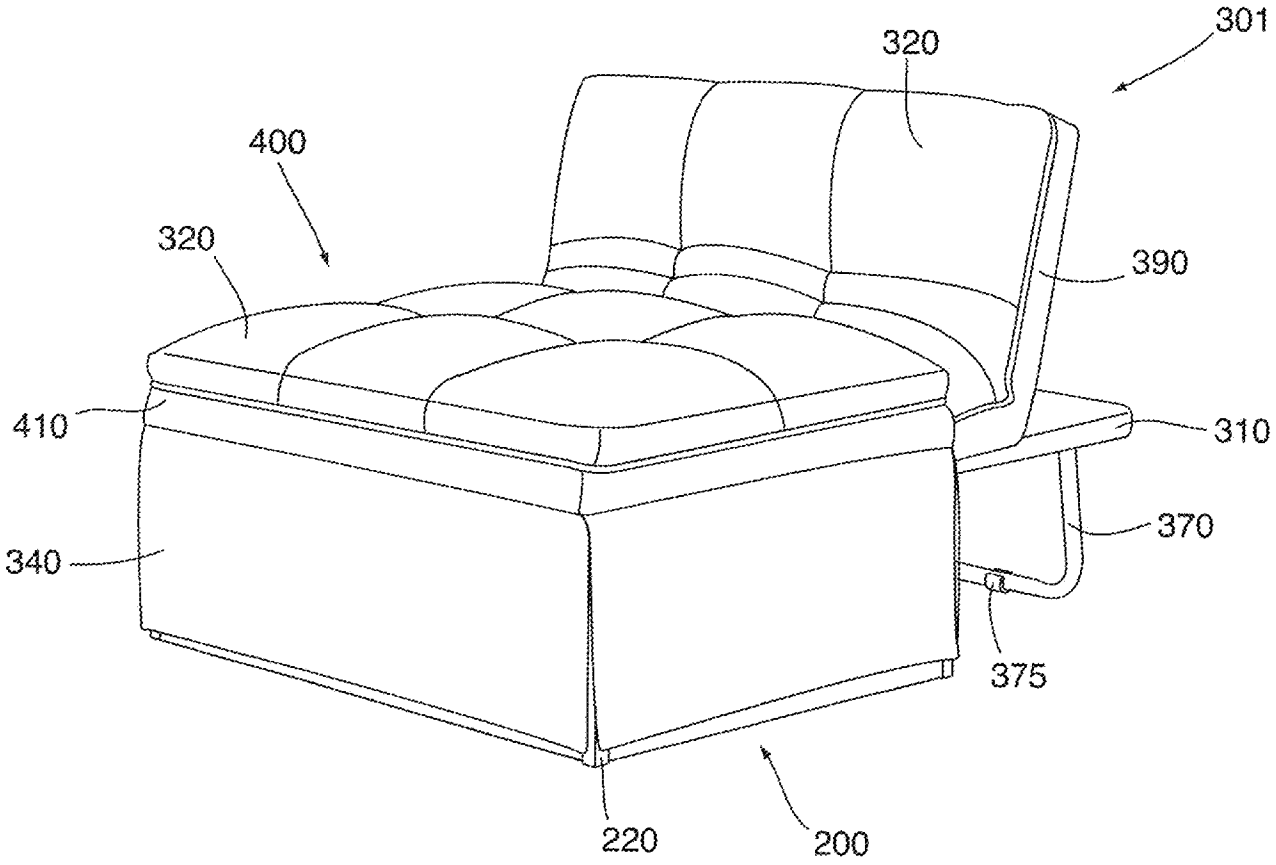
FIG. 12 is a perspective view of the foldable ottoman of FIG. 11 wherein the unfolded sofa segment is in a fully elevated position according to an embodiment of the present invention.

As shown in FIG. 12, the second supporting platform end 394 of the supporting platform 390 is tilted up by a user and off the segment base 310 into a substantially upright position.

Figure 13:
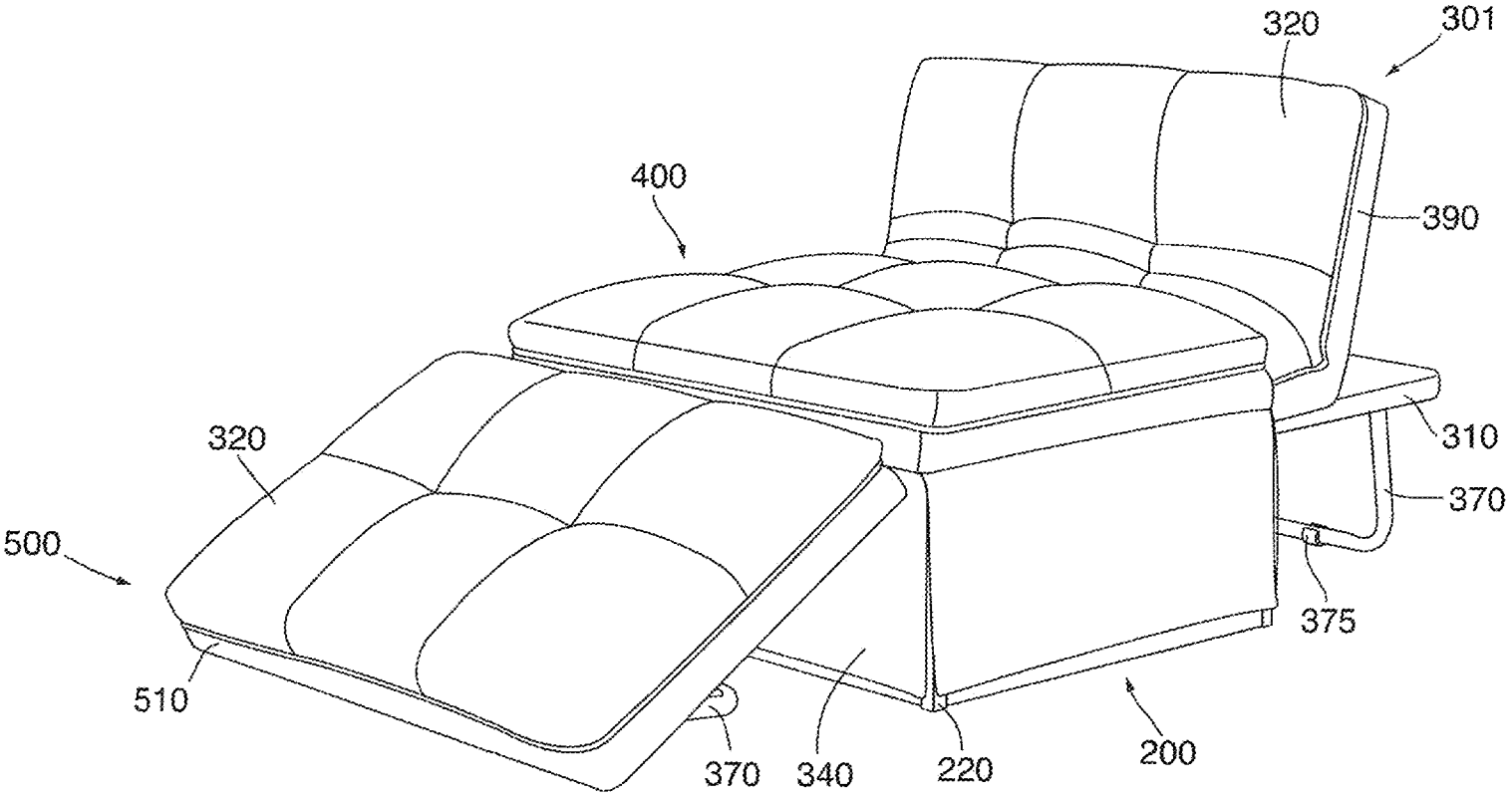
FIG. 13 is a perspective view of the foldable ottoman of FIG. 12 wherein one sofa segment is in a fully elevated position and another sofa segment is in a lowered position according to an embodiment of the present invention.

As shown in FIG. 13, the second supporting platform end 394 of the supporting platform 390 is tilted up and off the first end segment base 310 into a substantially upright position to act as a backrest and the leg handle 370 of the second end segment 500 is in a partially folded position allowing one end of the second end sofa portion base 510 to contact the around.

In operation, the segments 300, 400, 500 can be moved, folded or unfolded to form various different kinds of furniture arrangements. For example, as shown in FIG. 1, the foldable ottoman is in a first position and can be used as a traditional ottoman. As shown in FIGS. 2 and 3 whereby the foldable ottoman is in a second position, when housed inside the base frame 200, the first and second end segments 300, 500 can be accessed by first lifting the center segment 400 like a lid. As shown in FIGS. 4 and 5, to move the ottoman from the second position to the third position, a user can grab the leg handle 370 of the first end segment 300 to lift, pivot and unfold said first end segment 300 outside of the base frame 200.

In the third position, the leg handle 370 of the second end segment 500 is revealed and can be grabbed to lift, pivot and unfold the second end segment 500 outside of the base frame 200 to move the foldable ottoman in the fourth position, as shown in FIGS. 6 and 7. Once the first and second end segments 300, 500 are outside of the base frame, a user can use the base frame for storage (e.g., for other cushions, clothing, board games). If the user then moves the center segment 400 back on the base frame legs 220, the foldable ottoman is in the fifth position as shown in FIG. 8 and can be used as a sofa without a back, or a sofa bed.

As shown in FIGS. 9 and 10, in an embodiment of the invention where the first end segment 300 comprises a first end segment base 310 underneath the supporting platform 390, a user can tilt the second supporting platform end 394 of the supporting platform 390 up and off the supporting platform 390 by a click clack mechanism 395, which is known in the art. When the foldable ottoman is arranged as shown in FIG. 10 in particular, it can be used as a typical recliner with a backrest and footrest. As shown in FIG. 13, a user can partially fold the leg handle 370 of the second end segment 500 to change the angle of said second end segment that could act as a footrest.

The foldable ottoman can also be easily moved into the sixth position as shown in FIG. 11, by moving the foldable ottoman into the third position as shown in FIG. 4 and then moving the center segment 400 into the closed position while the second end segment 500 is still folded and housed inside the base frame 200. In the sixth position, the foldable ottoman can act as an extended ottoman or a traditional sofa with reclining backrest as shown in FIG. 12.

While the embodiment shown and described herein depicts the tiltable supporting platform 390 on the first end segment 300 only, it is nevertheless understood that a tiltable supporting platform could be on the first and second end segments (300, 500), the first end segment only (300), or the second end segment only (500).

It is understood that the foldable ottoman of the present invention is easier to transport, store, and quickly assemble/disassemble as compared to full-length sofas, recliners and sofa beds that are not convertible to an ottoman.

While embodiments of the invention have been described in the detailed description, the scope of the claims should not be limited by the preferred embodiments set forth in the examples but should be given the broadest interpretation consistent with the description as a whole.

What is claimed is:

1. A foldable ottoman comprising, a base frame having base frame supporting members and four base frame legs, a center segment having a center segment base that is pivotally attached to a first two of the four base frame legs, a first end segment having a first end segment base that is pivotally attached to a second two of the four base frame legs wherein one of the second two of the four base frame legs is the same as a first one of the first two of the four base frame legs, and a second end segment having a second end segment base that is pivotally attached to a third two of the four base frame legs that are different than the second two of the four base frame legs and includes a second one of the first two of the four base frame legs and a pivotable leg handle attached to the second end segment base.

2. The foldable ottoman of claim 1, additionally comprising a supporting platform having a first supporting platform end and a second supporting platform end, wherein the supporting platform is adjacent to the first end segment, the first supporting base end is attached to the first end segment base, and the second supporting platform end is moveably attached to the first supporting platform end.

3. The foldable ottoman of claim 2, wherein the first supporting platform end is moveably attached to the second supporting platform end by a click clack mechanism.

4. The foldable ottoman of claim 2, wherein the pivotable leg handles further comprise grips.

5. The foldable ottoman of claim 2, wherein the center segment base is pivotally attached to two of the four base frame legs using segment links attached to the center segment base and the two of the four base frame legs.

6. The foldable ottoman of claim 2, wherein the first end segment is pivotally attached to the second two of the four base frame legs using segment links attached to the first end segment base and the second two of the four base frame legs.

7. The foldable ottoman of claim 2, wherein the second end segment base is pivotally attached to the third two of the four base frame legs using segment links attached to the second end segment base and the third two of the four base frame legs.

8. A foldable ottoman comprising, a base frame having base frame supporting members and four base frame legs, a center segment having a center segment base that is pivotally attached to a first two of the fourbase frame legs, a first end segment having a first end segment base that is pivotally attached to a second two of the four base frame legs wherein one of the second two of the four base frame legs is the same as a first one of the first two of the four base frame legs, a second end segment having a second end segment base that is pivotally attached to a third two of the four base frame legs that are different than the second two of the four base frame legs and includes a second one of the first two of the four base frame legs and a pivotable leg handle attached to the second end segment base, wherein the center segment, the first end segment, and the second end segment are upholstered.

9. The foldable ottoman of claim 8, additionally comprising a supporting platform having a first supporting platform end and a second supporting platform end, wherein the supporting platform is adjacent to the first end segment, the first supporting base end is attached to the first end segment base, and the second supporting platform end is moveably attached to the first supporting platform end.

10. The foldable ottoman of claim 9, wherein the first supporting platform end is moveably attached to the second supporting platform end by a click clack mechanism.

11. The foldable ottoman of claim 9, wherein the pivotable leg handles further comprise grips.

12. The foldable ottoman of claim 9, wherein the center segment base is pivotally attached to two of the four base frame legs using segment links attached to the center segment base and the two of the four base frame legs.

13. The foldable ottoman of claim 9, wherein the first end segment is pivotally attached to the second two of the four base frame legs using segment links attached to the first end segment base and the second two of the four base frame legs.

14. The foldable ottoman of claim 9, wherein the second end segment base is pivotally attached to the third two of the four base frame legs using segment links attached to the second end segment base and the third two of the four base frame legs.

15. A foldable ottoman comprising a base pivotally attached to a first end segment, a center segment and a second end segment, wherein the ottoman is capable of moving from a first closed position in which the first end segment and second end segment are in a folded position inside the base and the center segment covers the base, to:

a second position in which the center segment is extended away from the base and the first end segment and second end segment are in a closed position inside the base;

a third position in which the center segment is extended away from the base and the first end segment is in an unfolded extended position outside of the base and the second end segment is in a closed position inside the base;

fourth position in which the center segment is extended away from the base, the first end segment and second end segment are all in an unfolded extended position outside of the base and the first end segment extends in a first direction from the base and the second end segment extends from the base in a second direction opposite to the first direction; and a fifth position in which the first end segment and second end segment are in unfolded extended positions outside of the base and the center segment covers the base.

16. The foldable ottoman of claim 15, wherein the first end segment comprises a first end segment base and a supporting platform having a first supporting platform end and a second supporting platform end, where the supporting platform is adjacent to the first end segment and attached to the first end segment at the first supporting platform end and the first supporting platform end is connected to the second supporting platform end by a click clack mechanism, wherein the ottoman is capable of moving to a sixth position in which the first end segment and second end segment are in unfolded extended positions outside of the base and the center segment is folded back into a closed position on the base and the second supporting platform end is elevated up from the first segment base.

17. The foldable ottoman of claim 15, wherein the second end segment comprises a second end segment base and a supporting platform having a first supporting platform end and a second supporting platform end, where the supporting platform is adjacent to the second end segment and attached to the second end segment at the first supporting platform end and the first supporting platform end is connected to the second supporting platform end by a click clack mechanism, wherein the ottoman is capable of moving to a seventh position in which the first end segment and second end segment are in unfolded extended positions outside of the base and the center segment is folded back into a closed position on the base and the second supporting platform end is elevated up from the second segment base.

18. The foldable ottoman of claim 15, wherein the first end segment comprises a first end segment base and a supporting platform having a first supporting platform end and a second supporting platform end, where the supporting platform is adjacent to the first end segment and attached to the first end segment at the first supporting platform end and the first supporting platform end is connected to the second supporting platform end by a click clack mechanism, and wherein the second end segment comprises a second end segment base and a supporting platform having a first supporting platform end and a second supporting platform end, where the supporting platform is adjacent to the second end segment and attached to the second end segment at the first supporting platform end and the first supporting platform end is connected to the second supporting platform end by a click clack mechanism and wherein the ottoman is capable of moving to an eighth position in which the first end segment and second end segment are in unfolded extended positions outside of the base and the center segment is folded back into a closed position on the base and the second supporting platform end is elevated up from the first segment base and the second supporting platform end is elevated from the second segment base.

* * * * *